United States Patent [19]

Auer, Jr. et al.

[11] 4,118,750

[45] Oct. 3, 1978

[54] VITAL RELAY OPERATING CIRCUIT

[75] Inventors: John H. Auer, Jr., Fairport; Henry C. Sibley, Adams Basin, both of N.Y.

[73] Assignee: General Signal Corporation, Rochester, N.Y.

[21] Appl. No.: 759,304

[22] Filed: Jan. 14, 1977

Related U.S. Application Data

[63] Continuation of Ser. No. 606,695, Aug. 21, 1975, abandoned.

[51] Int. Cl.[2] ..... H01H 47/22

[52] U.S. Cl. ..... 361/182; 246/34 CT; 361/187; 340/48

[58] Field of Search ..... 361/182, 183, 187, 191, 361/192, 193; 340/47, 48, 49, 50, 253 Y; 246/34 CT, 34 R; 307/252 UA

[56] References Cited

U.S. PATENT DOCUMENTS

| | | | |
|---|---|---|---|
| 2,838,719 | 6/1958 | Chitty | 246/34 CT |
| 3,202,967 | 8/1965 | Wolff | 361/183 |
| 3,715,669 | 2/1973 | LaForest | 246/34 CT |
| 3,828,225 | 8/1974 | Grundy | 361/182 |

*Primary Examiner*—Gerald Goldberg

*Attorney, Agent, or Firm*—Milton E. Kleinman; George W. Killian

[57] ABSTRACT

There is disclosed a circuit for energizing a vital relay in response to an input signal that is modulated between two frequencies. A discriminator circuit responds to the modulated frequencies and alternately produces an output patented of one polarity and then a reverse polarity in response to the modulated signals. Coupled between the discriminator and the vital relay is a relay driver which responds to the output of the discriminator and energizes the vital relay. A d.c. power supply is coupled to the relay driver. The vital relay includes two windings. Failure of the modulation, the d.c. source or virtually any circuit element, will result in release of the vital relay. The disclosed embodiment uses photoresistors as switching elements.

18 Claims, 4 Drawing Figures

VITAL RELAY OPERATING CIRCUIT

This is a continuation, of Application Ser. No. 606,695, filed Aug. 21, 1975, now abandoned.

BACKGROUND OF THE INVENTION

Track circuits are well known and widely used in railway signalling systems. For the purposes of this description, a track circuit may be defined as a circuit which is designed to detect and respond to the presence of a train within the boundaries of a specified section of track. There may be loss of life and/or equipment damage if a track circuit should fail to indicate the presence of a train. In response to the detection of a track, a track circuit may provide signals at a highway crossing for lowering gates and providing other audible and/or visual signals. If a track circuit should indicate the presence of a train when there is no train, considerable inconvenience may be caused. However, such inconvenience is considered more desirable than the failure of the track circuit to indicate the presence of a train when there is a train. Accordingly, part of the philosophy of design of track circuits is that under no circumstances should the track circuit indicate there is no train when there is, in fact, a train. The track circuit should respond, as described under normal conditions and even when there is a wide variety of faults and/or malfunctions such as blown fuses, voltage out of tolerance, some wiring errors, insulation failure, dirt, dust or moisture or defective components, etc. In summary, the track circuit should never indicate the absence of a train when there is a train.

The relay which provides the signal indicative of the presence, or absence, of a train is referred to as a vital relay. A wide variety of circuits have been used to control vital relays and provide safe operating conditions.

One of the more obvious circuit considerations for actuating a vital relay is that it will be electrically energized when there is no train within the limits supervised by the track circuit. If the system depended upon the actuation of the relay in response to the presence of a train, there is the possibility that the relay would fail to operate for any number of reasons including: a power failure, a broken wire, dust or shorted equipment. Also, it is fairly obvious that the vital relay should be physically oriented so that gravity will move its contacts to the release position if it is not electrically actuated. Many other factors which are well known to those skilled in the art are considered in the design of track circuits and vital relays.

It is standard practice to apply a signal to the track near one end of the supervised boundary and to actuate a vital relay in response to the detection of the signal near the other end of the supervised boundary. The presence of a train within the supervised boundary is indicated by a shunt caused by the wheels and axle of the train between the two tracks.

SUMMARY OF THE INVENTION

The present invention is directed to a circuit for actuating a vital relay in response to signals applied to a track at a distant point. The signal applied to the track is a unique signal which is detected by the vital relay control circuit located some distance down the track. To prevent false signals, the frequency of the unique signal is selected from among those that are unlikely to be inadvertently duplicated or induced into the track.

The applied signal is modulated in frequency above and below a nominal frequency at a relatively slow rate. Depending upon a variety of conditions, the nominal frequency may vary from approximately 600 hertz to 12,000 hertz and the modulation may vary the frequency a few percent above and below the nominal frequency at a rate of the order of 10 or 12 hertz. In order to assure that the vital relay is not actuated, except in response to the generation and detection of the appropriate signals, the systems includes a discriminator for detecting and responding to the modulated signals. The modulated signals are rectified and the resultant rectified potentials are connected in series opposition. Failure of the resultant potential, of the series connected opposing potentials, to change polarity indicates loss of a modulation signal and will result in release of the vital relay. Electrical isolation and switching is provided by optical isolators. The vital relay is a two winding relay with one winding energized when the resultant potential is of one polarity and the other winding energized when the resultant potential is of the other polarity. If either polarity fails, an inhibiting circuit is provided which prevents the remaining signal from energizing the vital relay on just one of its windings.

DESCRIPTION OF THE PREFERRED EMBODIMENT

Figure 1:
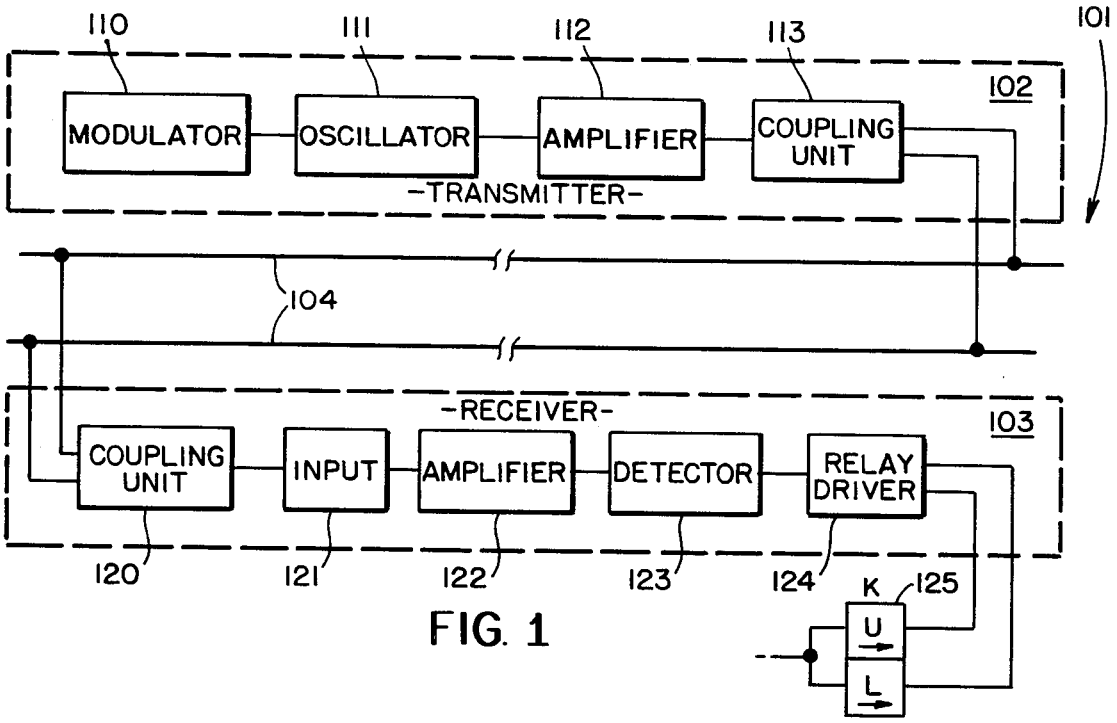
FIG. 1 is a block diagram of the various components of a track circuit.

The advantages and utility of the invention may be more fully appreciated by considering the function of the circuit of the invention in an overall system. For this purpose, attention is directed to FIG. 1 which discloses a track circuit 101 comprising a transmitter 102 and a receiver 103 coupled to a pair of rails 104. The transmitter 102 is coupled to the rails 104 at one end of the track circuit while the receiver 103 is coupled to the rails 104 at the other end. The length of the track circuit may vary from approximately 1,000 feet to 1 mile. The transmitter 102 includes a modulator 110 which frequency modulates the a.c. signal generated by the oscillator 111 so that the output of the oscillator 111 varies between two frequencies; one of which is a little above, and the other a little below, the nominal frequency of the oscillator 111. The nominal frequency of the oscillator 111 will have a predetermined value which is selected to be most appropriate for the application under consideration, but which will normally fall within the range of approximately 600 hertz to about 12,000 hertz. The output of the oscillator 111 is applied to the amplifier 112, the output of which is, in turn, applied to the coupling unit 113 to couple the signal to the tracks 104. The receiver 103 includes a coupling unit 120 which couples the receiver to the tracks 104 and picks up the signal from the transmitter 102 and applies it to the input circuit 121. The signal from the input circuit 121 is applied to the amplifier 122 and the output of the amplifier 122 is applied to the detector 123. The output of the detector 123 is applied to the relay driver 124 which provides a signal to actuate the relay 125. The relay 125 includes contacts, not shown in FIG. 1, which actuate signals and/or alarms indicative of the state of relay 125. Under normal conditions, with no train occupying any part of the track 104 between the connection of the transmitter 102 and the receiver 103, the relay 125 will be maintained operated. The elements 110 to 122 may comprise any of a wide variety of known circuits and are not shown herein in detail.

Figure 2:
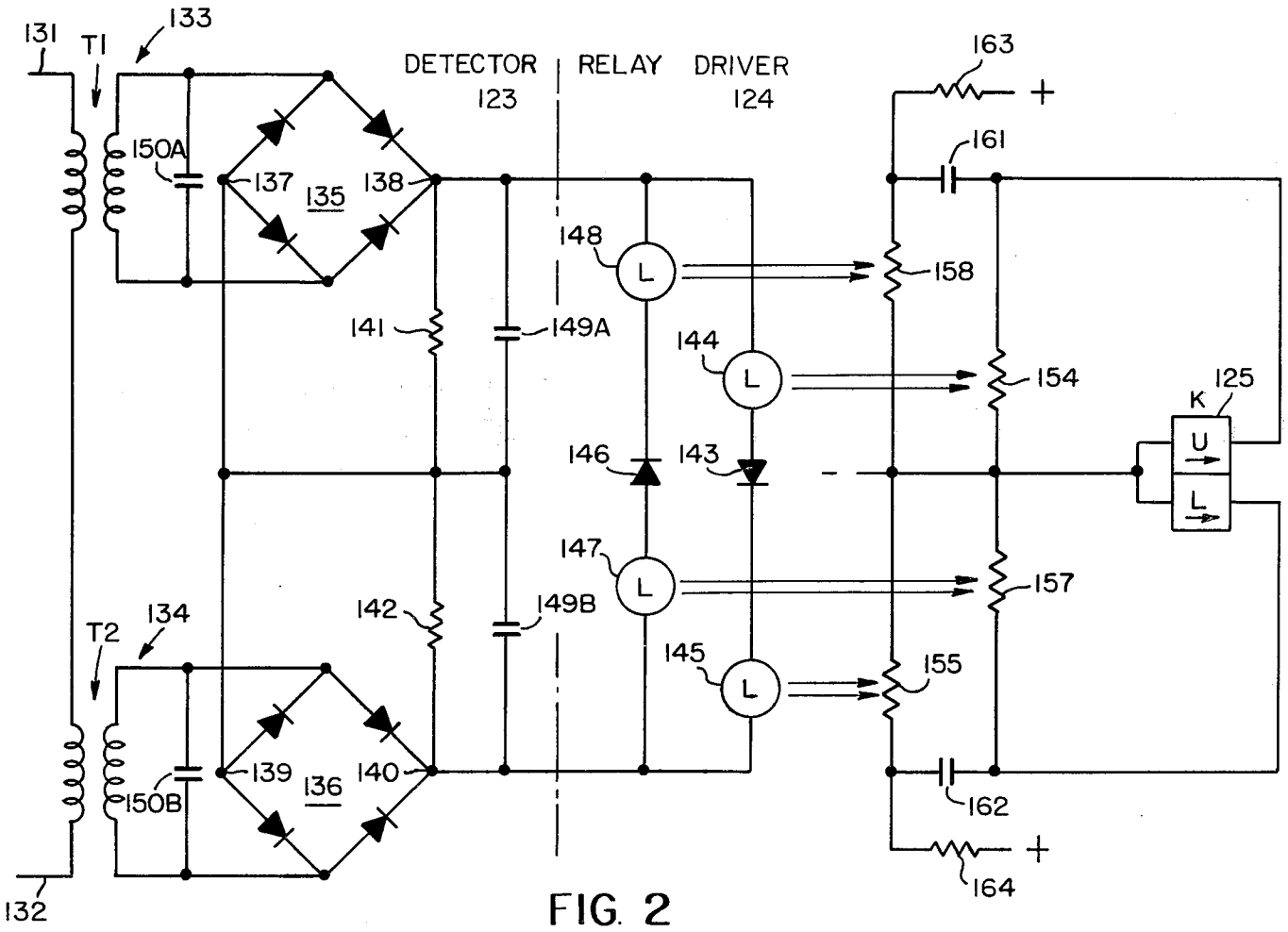
FIG. 2 is a more detailed circuit of the vital relay driver and vital relay.

The circuit of the invention is more clearly shown in FIG. 2 which is a more detailed circuit of the detector 123, relay driver 124 and the relay 125 shown in block diagram form in FIG. 1.

The circuit of FIG. 2 receives a frequency modulated input signal. More specifically, the input signal applied to the input leads 131 and 132 of the detector 123 of FIG. 2 has an appearance similar to that shown in FIG. 3A. That is, for the period of time between time $t_0$ and $t_1$, the frequency of the signal applied to input leads 131 and 132 may be a relatively high frequency. Subsequently, between time $t_1$ and $t_2$, the frequency of the input signal applied to leads 131 and 132 may be a relatively low frequency. The input signal alternates between the high and low frequency at a relatively low rate. As already mentioned, the nominal frequency may range from approximately 600 hertz to about 12,000 hertz and the modulated frequencies may be about 5% above and below the nominal frequency. As an example, if the nominal frequency is approximately 1,000 hertz, the high frequency might be of the order of 1,050 1 hertz and the low frequency of the order of 950 hertz and the rate of change between the two frequencies may occur at approximately 10 hertz so that a given frequency appears as an input for approximately 100 miliseconds. Other frequencies and timing intervals may be used as may be expedient for the particular application. The frequencies are selected so that neither modulated frequency has a dominant harmonic of the other frequency.

The input signal applied to leads 131 and 132 is coupled to a high frequency filter 133 and a low frequency filter 134. The output of the high frequency filter 133 will be applied as an input to the high frequency bridge 135 and the output of the low frequency filter 134 will be applied as an input to the low frequency bridge 136. It will be observed that the output terminals 137 and 139 of the bridges 135 and 136, respectively, are coupled together. Resistors 141 and 142 are coupled between the output terminals 138 and 140 of the bridges 135 and 136, respectively.

Because only one of the frequencies dominates on the input leads 131 and 132 at any given time, one of the bridges 135 or 136 will produce a dominant d.c. output potential. At a time that bridge 135 is producing the dominant output potential, it will be seen that current can flow from output terminal 138 through resistor 141 and back to terminal 137. In a similar manner, when bridge 136 is producing the dominant output potential, current may flow from terminal 140 through resistor 142 and back to terminal 139.

Connected in series across the output terminal pairs 138 and 140 is a first diode 143 and a pair of lamps 144 and 145. In addition, connected in series across the same terminals is a second diode 146 and a pair of lamps 147 and 148. At the time that the bridge 135 is producing the dominant output potential, current may flow through the series circuit of diode 143, lamps 144 and 145 and resistor 142. That is, the series combination of the lamp 144, diode 143, lamp 145 and resistor 142 are all in parallel with resistor 141 and connected across the output terminals 137 and 138 of the bridge 135. In a similar manner, when the bridge 136 is producing the dominant output potential, it will be seen that the lamp 147, the diode 146, the lamp 148 and the resistor 141 are all in series with the combination in parallel with the resistor 142.

In summary, it will be seen that when bridge 135 is producing the dominant output potential, current will flow through lamps 144 and 145, but no current will flow through lamps 147 and 148. Accordingly, during the time that a high frequency appears as an input across leads 131 and 132, the lamps 144 and 145 will be illuminated. In a similar manner, when a low frequency appears across the input terminals 131 and 132, the lamps 147 and 148 will be illuminated.

The portion of the circuit of FIG. 2 comprising the elements numbered from 131 to 142, 149A, 149B, 150A and 150B will be seen to comprise the detector 123 or a discriminator or frequency demodulator. That is, this portion of the circuit of the relay driver produces a first output polarity in response to the detection of a signal of a first particular frequency and it produces a reverse output polarity in response to the detection of a signal of a second particular frequency. Other forms of discriminators or frequency demodulators could be used.

The capacitors 149A and 149B serve to filter out some of the ripple of the output of the bridges 135 and 136, respectively. The capacitors 150A and 150B, in combination with their respective associated transformers T1 and T2, comprise tuning circuits for passing a predetermined dominate frequency to the respective bridges 135 and 136.

Figure 3A:
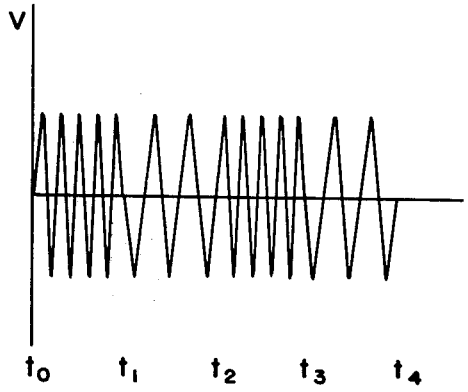
FIGS. 3A and 3B represent the modulated input signal applied to the circuit of FIG. 2 and the output potential of the discriminator.
Figure 3B:
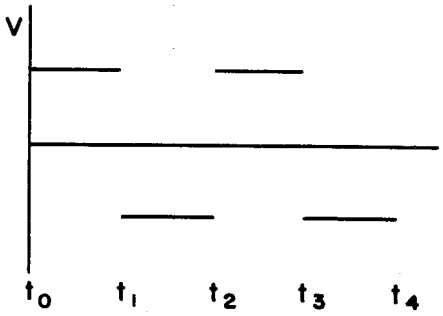

It will be evident that if either the high or low frequency should fail to appear, the potential at terminals 138 and 140 will not periodically reverse with respect to each other and one pair of lamps will never be illuminated. Thus if one particular frequency dominates continuously instead of intermittently, one pair of lamps will remain illuminated. If the frequencies dominate sequentially, as illustrated in FIG. 3A, only one pair of lamps will be illuminated at a time and when one pair is extinguished the other pair will be illuminated. — This occurs because the potential of terminal 138 is alternately positive and negative with respect to terminal 140. That is, as illustrated in FIG. 3B, the potential of one of the terminals 138, or 140, reverses with respect to the other at times $t_1$, $t_2$, $t_3$ etc. which coincides with the times, as illustrated in FIG. 3A, that the frequency of the input signal applied to terminals 131 and 132 changes.

The lamps 144, 145, 147 and 148 could comprise incandescent lamps, but may also comprise light emitting diodes.

The lamps 144, 145, 147 and 148 are each part of an optical isolator. More specifically, the lamp 144 is associated with the photoresistor 154; the lamp 145 is associated with photoresistor 155; the lamp 147 is associated with photoresistor 157 and the lamp 148 is associated with photoresistor 158. The photoresistors 154, 155, 157 and 158 have the characteristic that they exhibit a relatively low resistance when the associated lamp is illuminated and they exhibit a relatively high resistance when the associated lamp is dark. The low resistance may be of the order of approximately 100 ohms while the high resistance is several orders of magnitude greater and may be of the order of 100,000 ohms.

The relay K comprises two windings; an upper winding U and a lower winding L. Under normal conditions, current passes through only one winding of the relay K at a time and when the current is terminated in one winding, it is initiated in the other winding. Under these conditions, the relay K will operate and remain operated. It will be shown that the circuit of FIG. 2 cannot provide sustained current in either winding.

In FIG. 2, the symbol designation "+" is symbolic of the positive terminal of a d.c. power supply. In a similar manner, the symbol designation "−" is symbolic of the negative terminal of the same d.c. power supply. The d.c. power supply may have any convenient d.c. potential depending upon the characteristics of the relay K and the value of the other components within the system. In a typical system, the d.c. potential may be of the order of 12 volts and might vary ± 50%. If it is assumed the lamps 144, 145, 147 and 148 are dark and that, therefore, their associated photoresistors are exhibiting their high resistance values and if the resistors 163 and 164 have a value which is low relative to the high resistance of the photoresistor 154, 155, 157 and 158, the left hand side of the capacitors 161 and 162 will be at the positive potential while the right hand side of the capacitors 161 and 162 will be at the negative potential. With the capacitors 161 and 162 charged, as suggested, the potential on both terminals of both windings of the K relay will be negative and no current will tend to flow in either winding of the K relay. The K relay is a relay known as a biased neutral relay and cannot operate in response to the flow of current in the reverse direction in either or both windings thereof. The arrows indicate the direction that conventional current must flow in order to operate the relay K. If through some accident, error or malfunction, capacitor 161 should become shorted, there will be a tendency for current to flow from the "+" terminal of the d.c. power source through resistor 163, the shorted capacitor 161 and in the reverse direction through the U winding of relay K to the "−" terminal of the d.c. power source. In a similar manner, if capacitor 162 should become shorted a current could flow through resistor 164, shorted capacitor 162, and the lower winding L of relay K to the "−" terminal of the d.c. power supply. However, as already indicated, the relay K does not operate in response to reverse current in either or both windings. Accordingly, the relay K cannot operate as a result of shorted capacitors 161 and 162.

When the left hand portion of the circuit of FIG. 2 is functioning properly, that is, with the periodic polarity reversals across terminal pair 138 and 140, lamp 144 and 145 will be illuminated during alternate intervals of time and the lamp pair 147 and 148 will be illuminated during the intermediate intervals of time. The photoresistors 154 and 155 will exhibit their low resistance while the lamp pair 144 and 145 is illuminated and the photoresistors 157 and 158 will exhibit their low resistance while the lamp pair 147 and 148 is illuminated. Phrased differently, under normal operating conditions, the photoresistors with even numbers cannot both exhibit either the high or low resistance simultaneously. In a similar manner, the odd numbered photoresistors cannot simultaneously exhibit either the high or low impedance. Or phrased in another alternate manner, while one of the pairs of photoresistors, having consecutive numbers, exhibits low impedance, the other pair of photoresistors exhibits high impedance.

If the photoresistors 154 and 155 have just shifted to their low impedance value, the capacitor 161 can charge with a positive potential on its left hand terminal and a negative potential on its right hand terminal. The resistance of resistor 163 is considered to be relatively low with respect to the high value of photoresistor 158. For the present, the effect of capacitor 162 will be ignored. Now assume that photoresistor 154 is shifted to its high impedance value and simultaneously therewith photoresistor 158 is shifted to its low impedance value. Under these conditions, the left hand terminal of capacitor 161 will be suddenly shifted to the "−" potential. The right hand terminal of capacitor 161 was negative with respect to the left hand terminal and, therefore, the right hand terminal of capacitor 161 is now at a potential more negative than the "−" potential. The capacitors 161 and 162 are in a voltage doubler circuit. Accordingly, current will flow from the "−" terminal through the U winding of relay K to the more negative terminal at the right hand side of capacitor 161. Or, phrased differently, capacitor 161 discharges through the winding U of relay K in a direction to actuate relay K. While current is flowing in the U winding of relay K, the photoresistor 157 is also at its low impedance value and, therefore, the capacitor 162 is charged with a positive potential at its left hand terminal and negative potential at its right hand terminal. The resistance of resistor 164 is considered to be relatively low with respect to the high value of photoresistor 155.

When the photoresistors shift their impedance value, the photoresistors 154 and 155 will shift to the low impedance value while the photoresistors 157 and 158 will shift to their high impedance value. During this time, the capacitor 161 will charge as previously described. During the same interval of time, the left hand terminal of capacitor 162 is suddenly shifted to the "−" value of the d.c. power supply and, therefore, the right hand terminal of capacitor 162 which is negative, with respect to the left hand terminal, will be at a negative potential which is more negative than the "−" potential of the d.c. power supply. Accordingly, current will flow from the "−" potential through the L winding of relay K in a direction to operate relay K, or to maintain it operated. Or, phrased differently, during this interval of time, the capacitor 162 will discharge through the L winding of relay K.

Accordingly, while one of the capacitors of the pair 161 and 162 is being charged, the other capacitor of the pair will discharge through one of the windings of the relay K. In this manner, current is maintained in one winding or the other of the relay K and the relay K is maintained operated.

It has already been mentioned that relay K cannot be actuated if either capacitor 161 or 162 should become short circuited. In a similar manner, if any one of the photresistors 154, 155, 157 or 158 should exhibit a continuous high impedance, or a continuous low impedance, the capacitors cannot charge and discharge as described and the relay K will not be maintained operated. If one winding of the relay K should go open, the relay K will release during the time that current would otherwise flow in that winding. Thus, with one winding of the relay K open circuited, the relay K may actuate and drop out at the modulation frequency, thereby indicating a malfunction. A similar result would obtain if either winding of the relay K were short circuited. Obviously, the relay K cannot be maintained actuated without power from the "+" and "−" terminal of the d.c. power supply. In summary, the relay K cannot remain operated unless everything is functioning as intended. More specifically, the nominal frequency must be modulated at approximately the required rate as timed by the charge and discharge time of the capacitors 161 and 162. Also, both the high and low frequencies must be present and detected to actuate the lamps 144, 145, 147 and 148 in the required sequence to control the photoresistors 154, 155, 157 and 158. The photoresistors 154, 155, 157 and 158 serve as switches to control the charging and discharging of capacitors 161 and 162. Failure of the modulated frequencies to dominate alternately will result in failure of the photoresistor switches to switch between their high and low values. Thus, failure of the modulated frequencies to dominate alternately will result in failure to alternately charge and discharge the capacitors 161 and 162 and the vital relay K will release. The pulsing of a single frequency will cause only two of the four photoresistors 154, 155, 157 and 158 to serve as a switch and the capacitors 161 and 162 will not alternately charge and discharge and the vital relay K will not be maintained operated.

Other types of isolators might be proposed between the two sections of the circuit of FIG. 2. However, phototransistors might fail in such a way as to become a simple rectifier and thereby create an unsafe condition.

While there has been shown and described what is considered at the present to be the preferred embodiment of the invention, modifications thereto will readily occur to those skilled in the related arts. For example, other types of frequency demodulators and/or other types of optical isolators may be used. It is believed that no further analysis or description is required and that the foregoing so fully reveals the gist of the present invention that those skilled in the applicable arts can adapt it to meet the exigencies of their specific requirements. It is not desired, therefore, that the invention be limited to the embodiments shown and described, and it is intended to cover in the appended claims all such modifications as fall within the true spirit and scope of the invention.

What is claimed is:

1. Fail safe relay actuating means comprising in combination:

(a) an a.c. signal source modulated at a predetermined rate to signals of first and second frequencies;

(b) discriminator means coupled to said signal source rectifying said signals of said first and second frequencies for producing an output potential, between a pair of terminals, which reverses polarity at said predetermined rate in response to the modulation of said a.c. signal source; and (c) first and second polarity responsive means coupled in parallel between said pair of terminals for producing relay control signals in response to said polarity reversals.

2. The combination as set forth in claim 1 and including a voltage doubling circuit, coupled between said polarity responsive means and the relay for energizing the relay in response to said relay control signals.

3. The combination as set forth in claim 2, wherein the coupling between said polarity responsive means and the voltage doubling circuit comprises photoelectric coupling.

4. The combination as set forth in claim 3, wherein said voltage doubling circuit includes switching means.

5. The combination as set forth in claim 4, wherein said switching means comprises light responsive resistor means.

6. The combination as set forth in claim 1, wherein said discriminator means comprises rectification means for producing said reversing polarity output potential only in response to the alternate domination of said first and second frequencies.

7. The combination as set forth in claim 6 and including a voltage multiplying circuit, coupled between said polarity responsive means and the relay, for producing a relay actuating signal in response to said relay control signals.

8. The combination as set forth in claim 7, wherein said voltage multiplying circuit includes impedance means whose impedance is independent of the polarity of said relay actuating signal.

9. A circuit for actuating a vital relay in response to an a.c. signal being alternately modulated to signals of first and second frequencies and comprising in combination:

(a) first and second rectification means responsive to said first and second frequencies for producing first and second d.c. output potentials, respectively;

(b) said first and second d.c. output potentials coupled in series opposition across a terminal pair for producing an output potential having the polarity of the dominant one of said first and second d.c. output potentials;

(c) first and second polarity responsive control means bridged in parallel across said terminal pair for producing first and second signals and second and first signals, respectively, when the potential across said terminal pair is of the polarity of said first and second d.c. output potentials, respectively;

(d) first and second switching means coupled to said first and second polarity responsive control means, respectively, and responsive to said first signals for rendering said first and second switching means conducting; and responsive to said second signals for rendering said first and second switching means relatively nonconducting; and wherein (e) said first and second switching means control the flow of current to the vital relay.

10. The combination as set forth in claim 9, wherein said first and second switching means comprise light responsive resistor means.

11. The combination as set forth in claim 10, wherein said first and second polarity responsive control means include a source for emitting light only in response to the polarity across said terminal pair being said one polarity and said reverse polarity, respectively.

12. The combination as set forth in claim 9, wherein the only coupling between the combination of said first and second switching means and the vital relay, with said first and second control means, is photoelectric.

13. The combination as set forth in claim 9 and including means intercoupling said first and second switching means for interrupting the flow of operating current to the vital relay in response to the cessation of the alternate production of said first and second output potentials.

14. The combination as set forth in claim 13, wherein said intercoupling means includes a capacitor.

15. The combination as set forth in claim 14, wherein said first and second switching means and said intercoupling means comprises a voltage doubler.

16. The combination as set forth in claim 9, wherein said first and second switching means comprises impedance means whose impedance is independent of the polarity of the potential thereacross.

17. The combination as set forth in claim 16, wherein said first and second switching means comprises part of a voltage multiplying circuit coupled between said polarity responsive means and the relay, for producing a relay actuating signal in response to said control signals.

18. The combination as set forth in claim 17, wherein said voltage multiplying circuit produces said relay actuating signal only in response to the alternate receipt of said first and second signals by said first and second switching means.

* * * * *